United States Patent [19]

Charron

[11] Patent Number: 4,549,465

[45] Date of Patent: Oct. 29, 1985

[54] SLIDE STOP PLATE ASSEMBLY FOR A HANDGUN

[75] Inventor: Dwayne Charron, Springfield, Mass.

[73] Assignee: Bangor Punta Corporation, Greenwich, Conn.

[21] Appl. No.: 568,763

[22] Filed: Jan. 6, 1984

[51] Int. Cl.[4] ..... F41C 3/00

[52] U.S. Cl. ..... 89/196; 89/138

[58] Field of Search ..... 89/137, 138, 163, 196

[56] References Cited

U.S. PATENT DOCUMENTS 984,519 2/1911 Browning ..... 89/138

*Primary Examiner*—Stephen C. Bentley

*Attorney, Agent, or Firm*—Patrick J. Walsh

[57] ABSTRACT

Disclosed is a slide stop assembly for a handgun including a slide stop pivotal from an inoperative position into a position engaging the slide when the latter is in a recoiled position. A generally flat, shallow V-shaped, side plate is secured along one side of the frame against rotation or rocking movement. The securement is effected by engagement of the side plate at spaced points therealong with the respective hammer and sear pins of the handgun. One leg of the side plate extends forwardly and terminates in a tab. A spring biased plunger on the slide stop engages the tab to preclude inadvertent pivoting of the slide stop from its inoperative detented position into its slide stop position.

7 Claims, 3 Drawing Figures

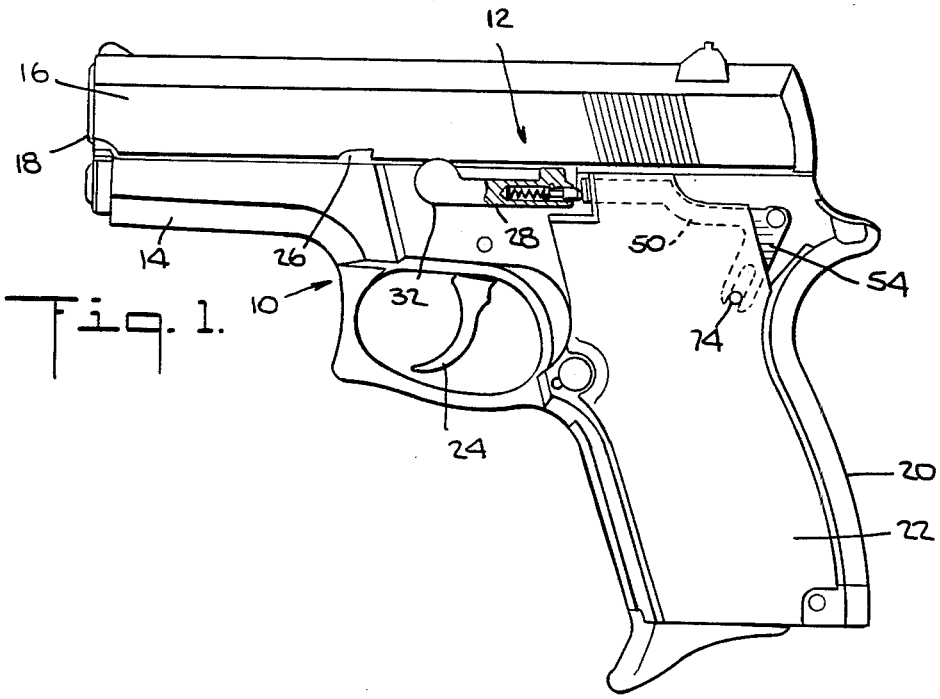
Fig. 1.
Fig. 2.
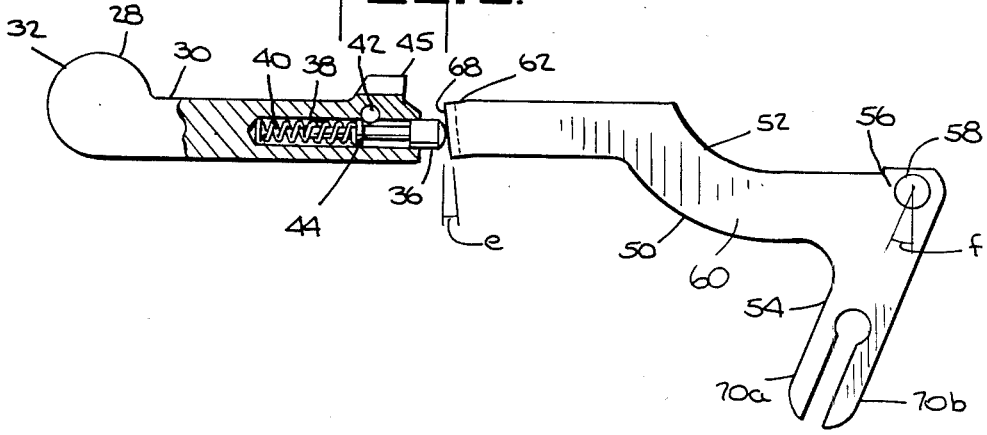
Fig. 3.
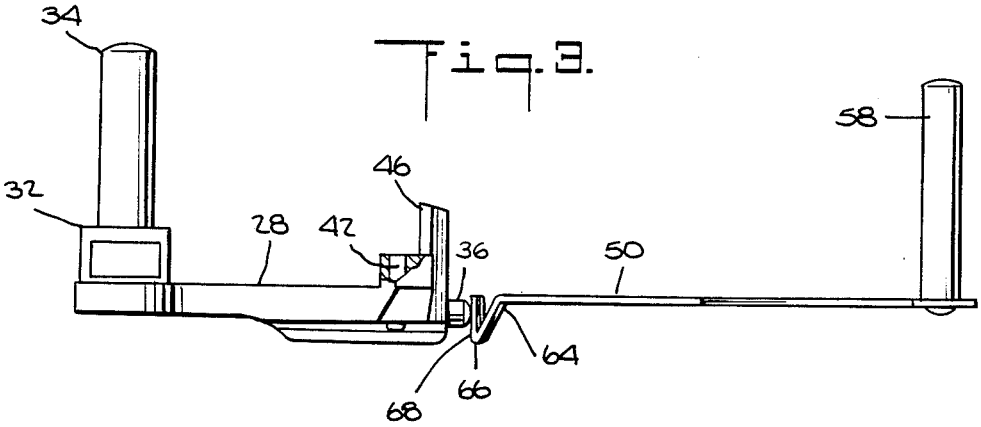

SLIDE STOP PLATE ASSEMBLY FOR A HANDGUN

BACKGROUND OF THE INVENTION

The present invention relates to a slide stop assembly for a handgun.

In automatic type handguns, the barrel of the handgun has a slide which recoils when the handgun is fired to eject the spent cartridge and chamber the next round. The slide then moves forwardly about the barrel and into the firing position. When the magazine is empty, a spring biased magazine follower engages a detent on the slide stop urging the slide stop to pivot upwardly. When the last cartridge is fired and the slide recoils, the slide stop pivots upwardly and engages the slide in its recoil position and prevents return of the slide into the firing position. When a new magazine is inserted, the slide stop is thumbed or pivoted into its release position enabling the slide under the bias of a recoil spring to return to its firing position.

Traditionally, the slide stop is maintained in its inoperative position by a rotatable button having a cam face engageable with the slide stop. There is a tendency however, for the cam to rotate when the handgun is fired or otherwise manipulated. Upon such rotation positive control over the position of the slide stop is relinquished resulting sometimes in interference between the slide stop and the slide and also in accidental and unwanted locking of the slide in its recoil position.

SUMMARY OF THE PRESENT INVENTION

It is a primary object of the present invention to provide a novel and improved slide stop assembly for handguns of the automatic type.

It is another object of the present invention to provide a novel and improved slide stop assembly for handguns of the automatic type wherein accidental or inadvertent release of the slide stop from its inoperative position is precluded.

It is still another object of the present invention to provide a novel and improved slide stop assembly for handguns of the automatic type wherein a uniquely shaped side plate is secured to the frame of the handgun against rotation and which side plate retains positive control over the slide stop to maintain it in its inoperative position spaced from the slide.

It is a further object of the present invention to provide a novel and improved slide stop assembly for handguns of the automatic type having the foregoing characteristics wherein the side plate is in part secured to the frame by means of the hammer pivot pin whereby an economy of parts in the handgun is achieved.

It is a still further object of the present invention to provide a novel and improved slide stop assembly for handguns of the automatic type having the foregoing characteristics and wherein the side plate is readily, easily and inexpensively manufactured and of a compact, generally flat, construction thereby reducing the bulk of the handgun.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing and other objects and advantages and in accordance with the purposes of the present invention as embodied and broadly described herein, a slide stop assembly constructed in accordance with the present invention comprises a slide stop carried by the handgun frame for movement between a first position permitting free movement of the slide relative to the frame between its firing and recoil positions and a second position engageable with the slide in its recoil position to retain the slide in such latter position, an elongated side plate for securement along one side of the frame and having elongated leg portions forming an apex at their junction intermediate the ends of the side plate, a pin secured to and extending laterally from the apex of the side plate into the frame to secure the side plate to the frame and serve as the pivot pin for the hammer, and means for securing one leg of the side plate to the frame whereby the pin and the securing means secure the side plate to the frame against rotation, an end portion of the other leg of the side plate engaging the slide stop to releasably retain the latter in its first position thereof and enable movement of the slide stop into its second position retaining the slide in the recoil position.

Preferably, the side plate is secured against rotation by its two point securement to the hammer pin and sear pin, respectively. Also, the free end portion of the other leg of the side plate includes a tab which is inclined to the vertical to detent the slide stop in its inoperative position.

The accompanying drawings which are incorporated in and constitute a part of this specification, illustrate one embodiment of the invention and, together with the description, serve to explain the principles of the invention.

BRIEF DESCRIPTION OF THE DRAWINGS

FIG. 1 is a side elevational view of a handgun of the automatic type illustrating a slide stop assembly constructed in accordance with the present invention and with a portion of the slide stop broken out and in cross section;

FIG. 2 is an enlarged side elevational view of the slide stop and side plate forming the slide stop assembly hereof and illustrating the slide stop in its inoperative position with portions of the slide stop broken out and in cross section; and FIG. 3 is an enlarged plan view of the slide stop and side plate illustrated in FIG. 2.

DESCRIPTION OF A PREFERRED EMBODIMENT

Reference will now be made in detail to the preferred embodiment of the present invention, an example of which is illustrated in the accompanying drawings.

Referring now to the drawings, particularly to FIG. 1, there is illustrated a handgun of the automatic type, generally designated 10, with a slide stop assembly constructed in accordance with the present invention and generally designated 12. Handgun 10 includes a frame 14, a slide 16 about a barrel 18, a handle 20 on opposite sides of which are pistol grips 22, and a trigger 24. The slide 16 includes a catch detent 26 on one side of the slide along a lower edge portion thereof. Handgun 10 operates in a conventional manner with the slide being displaced rearwardly upon firing and recoil into a recoil position. As conventional, the slide is retained in the recoil position by a slide stop assembly after the last cartridge in the magazine has been fired.

The slide stop assembly includes a slide stop 28 which, per se, is conventional in construction. Briefly, slide stop 28 includes an elongated body 30 having a hub 32 at one end and a pin 34 which projects into and is retained by the frame 14. The opposite end of body 30 includes a slide stop plunger 36 disposed in an axial cavity 38 containing a slide stop plunger spring 40. The plunger 36 is retained in cavity 38 by a pin 42 which engages a stop 44 on the plunger 36. The body includes a stop 45 along its upper side for engaging catch 26 of the slide 16. An arm 46 (FIG. 3) projects into the frame and into the path of movement of the magazine follower plate, not shown. When the last cartridge is fired, the follower plate engages arm 46 to pivot the slide stop counterclockwise, as seen in FIG. 1, about the axis of pin 34 out of its inoperative detented position to engage stop 45 with catch 26 of slide 16 in response to movement of the slide into its recoil position.

In accordance with the present invention, slide stop assembly 12 includes a side plate 50 which is secured to frame 14 against any pivoting or rocking movement and which cooperates with the slide stop 28 to retain the latter in its illustrated detented inoperative position. Specifically, side plate 50 includes a generally flat plate, preferably formed of metal, having a pair of legs 52 and 54 forming, at adjoining ends, an apex 56. The hammer pin 58 is secured to the apex 56 of the side plate and extends at right angles therefrom into the frame. The pin 58 serves not only as a point of securement for the side plate to the frame but also as the pivot pin for the hammer of the handgun.

Leg 52 of side plate 50 includes an intermediate arcuate portion 60 which forms a transition between apex 56 and the distal end portion 62 of leg 52. As best illustrated in FIG. 3, the distal end portion 62 is formed or bent laterally outwardly at 64 and then is reversely formed or bent laterally inwardly at 66 to form an end tab or plate 68. As illustrated in FIG. 2, end tab 68 declines downwardly and rearwardly toward the handgun handle as seen in FIG. 1, to form an angle e with vertical. Tab 68 thus forms a plate which is engaged by the plunger 36 of slide stop 28 to retain the latter in its illustrated inoperative position.

Leg 54 of side plate 50 declines downwardly and forwardly toward the trigger as illustrated in FIG. 1. Preferably, the centerline of leg 54 forms an angle f with a vertical through apex 56 of about 22.5 degrees. As best illustrated in FIG. 2, the distal end of leg 54 is bifurcated to form spaced leg portions 70*a* and 70*b*. The space between leg portions 70*a* and 70*b* receives the end of a sear pin 74. Sear pin 74 extends transversely across the frame to form a second point of securement of the side plate 50 to frame 14.

It will be appreciated from the foregoing description that side plate 50 is secured to frame 14 at two points, spaced one from the other, along the side plate thus preventing rotation or cocking movement of the side plate relative to the frame. In this manner, tab 68 is maintained in position, upon firing the handgun or other manipulation thereof, to prevent the slide stop from inadvertent displacement upwardly and engagement with the slide. It is only when the magazine follower plate, not shown, engages arm 46 that the slide stop may be pivoted about the axis of pin 34 into the stop slide position.

It will also be appreciated that side plate 50 is generally planar in construction thus reducing its bulk. Because of its specific configuration, the side plate readily fits between frame 14 and the handle grip 22. Still further, this construction enables a highly desired conservation of parts in the handgun by utilizing as the points of securement for the side plate both the necessary hammer pivot pin 58 and the sear pin 74. Thus, these pins serve, not only their normal function in the handgun, but also the additional function of securing the side plate to the frame. Thus, the side plate is secured to the frame without the necessity of additional parts or manufacturing operations.

It will be apparent to those skilled in this art that various modifications could be made in the slide stop assembly hereof without departing from the scope or spirit of the invention.

What is claimed is:

1. For use in a handgun having a frame, a slide carried by the frame for movement between firing and recoil positions, and a hammer, a slide stop assembly comprising:

a slide stop carried by said frame for movement between a first position permitting free movement of the slide relative to the frame between its firing and recoil positions and a second position engageable with the slide in its recoil position to retain the slide in such latter position;

an elongated side plate for securement along one side of the frame and having elongated leg portions forming an apex at their junction intermediate the ends of said side plate, a pin secured to and extending laterally from the apex of said side plate into the frame to secure the side plate to the frame and serve as the pivot pin for the hammer, and means for securing one leg of said side plate to the frame whereby said pin and said securing means secure said side plate to said frame against rotation, an end portion of the other leg of said side plate engaging said slide stop to releasably retain the latter in said first position thereof and enable movement of said slide stop into its second position retaining the slide in the recoil position.

2. A slide stop assembly according to claim 1 wherein said end portion includes a flat and said slide stop includes a spring biased plunger engageable with said flat for retaining the slide stop in said first position.

3. A slide stop assembly according to claim 2 wherein said plunger is movable in a generally horizontal direction generally parallel to the motion of the slide when in said first position thereof, said flat forming an acute angle with the vertical to prevent movement of said slide stop from its first position into its second position without depressing said plunger.

4. A slide stop assembly according to claim 1 wherein said securing means includes a bifurcation on the end of said one leg, and a sear pin extending generally at right angles to said side plate and secured in said frame having an end thereof disposed between the bifurcated one leg end.

5. A slide stop assembly according to claim 4 wherein said end portion includes a flat and said slide stop includes a spring biased plunger engageable with said flat for retaining the slide stop in said first position.

6. A slide stop assembly according to claim 2 wherein said plunger is movable in a generally horizontal direction generally parallel to the motion of the slide when in said first position thereof, said flat forming acute angle with the vertical to prevent movement of said slide stop from its first position into its second position without depressing said plunger.

7. A slide stop assembly according to claim 6 wherein the second mentioned pin constitutes a sear pin for the handgun.

* * * * *